US008939350B2

(12) United States Patent
Valencia

(10) Patent No.: US 8,939,350 B2
(45) Date of Patent: Jan. 27, 2015

(54) RECLOSABLE AND STACKABLE FOOD TRAY AND TRAY BLANK

(71) Applicant: Rock-Tenn Shared Services, LLC, Norcross, GA (US)

(72) Inventor: John Valencia, Johns Creek, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 0 days.

(21) Appl. No.: 13/827,396

(22) Filed: Mar. 14, 2013

(65) Prior Publication Data

US 2014/0263600 A1 Sep. 18, 2014

(51) Int. Cl.

| | |
|---|---|
| ***B65D 5/24*** | (2006.01) |
| ***B65D 5/42*** | (2006.01) |
| ***B65D 5/66*** | (2006.01) |

(52) U.S. Cl.

CPC ..... *B65D 5/244* (2013.01); *B65D 5/4204* (2013.01); *B65D 5/6655* (2013.01)

USPC ..... 229/103.3; 229/157; 229/186

(58) Field of Classification Search

CPC .... B65D 5/2057; B65D 5/2052; B65D 5/244; B65D 5/6608; B65D 5/6638; B65D 5/6635

USPC ..... 229/103.3, 152, 153, 156, 157, 186

See application file for complete search history.

(56) References Cited

U.S. PATENT DOCUMENTS

| | | | | | |
|---|---|---|---|---|---|
| 1,975,804 | A * | 10/1934 | Seifer | 206/216 |
| 2,409,736 | A * | 10/1946 | Caimi | 229/153 |
| 3,027,063 | A * | 3/1962 | Zastrow | 229/186 |
| 3,067,924 | A * | 12/1962 | Baker et al. | 229/157 |
| 4,687,130 | A * | 8/1987 | Beeler | 229/152 |
| 4,917,291 | A * | 4/1990 | Saiki et al. | 229/103.3 |
| 5,411,204 | A | 5/1995 | DeMay | |
| 8,590,707 | B2 * | 11/2013 | Sielski | 229/169 |
| 2005/0051461 | A1 * | 3/2005 | Bryant | 206/769 |
| 2012/0261298 | A1 * | 10/2012 | Hubbard et al. | 206/518 |

* cited by examiner

*Primary Examiner* — Gary Elkins

(74) *Attorney, Agent, or Firm* — Kilpatrick Townsend & Stockton LLP

(57) ABSTRACT

Disclosed are reclosable and stackable food trays formed from a single blank that are capable of being folded and glued on standard machinery. Embodiments of the invention include raised gussets that extend beyond the top edge of the side panels of the formed tray and beyond the top of the formed tray. In some embodiments, the raised gussets help prevent distortion in all dimensions and facilitate the stacking of multiple trays on top of one another such that the stacked trays cannot slide off the lower tray.

9 Claims, 8 Drawing Sheets

RECLOSABLE AND STACKABLE FOOD TRAY AND TRAY BLANK

FIELD OF THE INVENTION

Embodiments generally relate to reclosable and stackable food trays.

BACKGROUND

Reclosable and stackable food trays constructed from a cut, scored and folded blank are convenient for storing and transporting prepared food, for example, take-out from a restaurant or other prepared food service, such as but not limited to a self-service prepared food store. One example of such food trays are trays that are fully assembled and nested together at the point of sale of the food, with the end user filling the receptacle of the tray with food and closing the tray for transfer. In an effort to prevent leaking, some prior art containers require gluing flaps in such a way that the container is not reclosable. Still yet other reclosable cartons constructed from cut and scored blanks having substantially leak proof constructions require that adhesive be deposited on the interior of the carton between adjacent panels that form each corner of the carton. It is undesirable to have adhesive on the interior of the carton in close proximity to the stored food, especially given the fact that when exposed to high temperature the adhesive may soften and contaminate the food within the carton.

Other reclosable cartons constructed from a single cut and scored blank disclose a reclosable food tray comprising two pairs of opposing side panels which are hingedly connected to aid in sealing liquid within the fully constructed food tray. Under certain loading conditions or external forces trays of this type may experience dimensional distortion and the sides of the tray may slide under the top of the tray, allowing the contents to leak and weakening the sides of the tray. In an effort to minimize this dimensional distortion of the tray and weakening of the sides, some trays glue extra pieces of paperboard or "slices" of material to the sides of the tray to increase support on the sides of the tray. This solution requires additional cutting and gluing and cannot be completed on standard folding and gluing machinery.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Generally, reclosable and stackable food trays formed from a single blank that are capable of being folded and glued on standard machinery are provided. Embodiments of the invention include reclosable food trays comprising two pairs of opposing side panels which are hingedly connected by raised gussets. In some embodiments, the raised gussets extend beyond the top edge of the side panels of the formed tray and beyond the top of the formed tray to help prevent distortion in all dimensions and facilitate the stacking of multiple trays on top of one another such that the stacked trays cannot slide off the lower tray.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
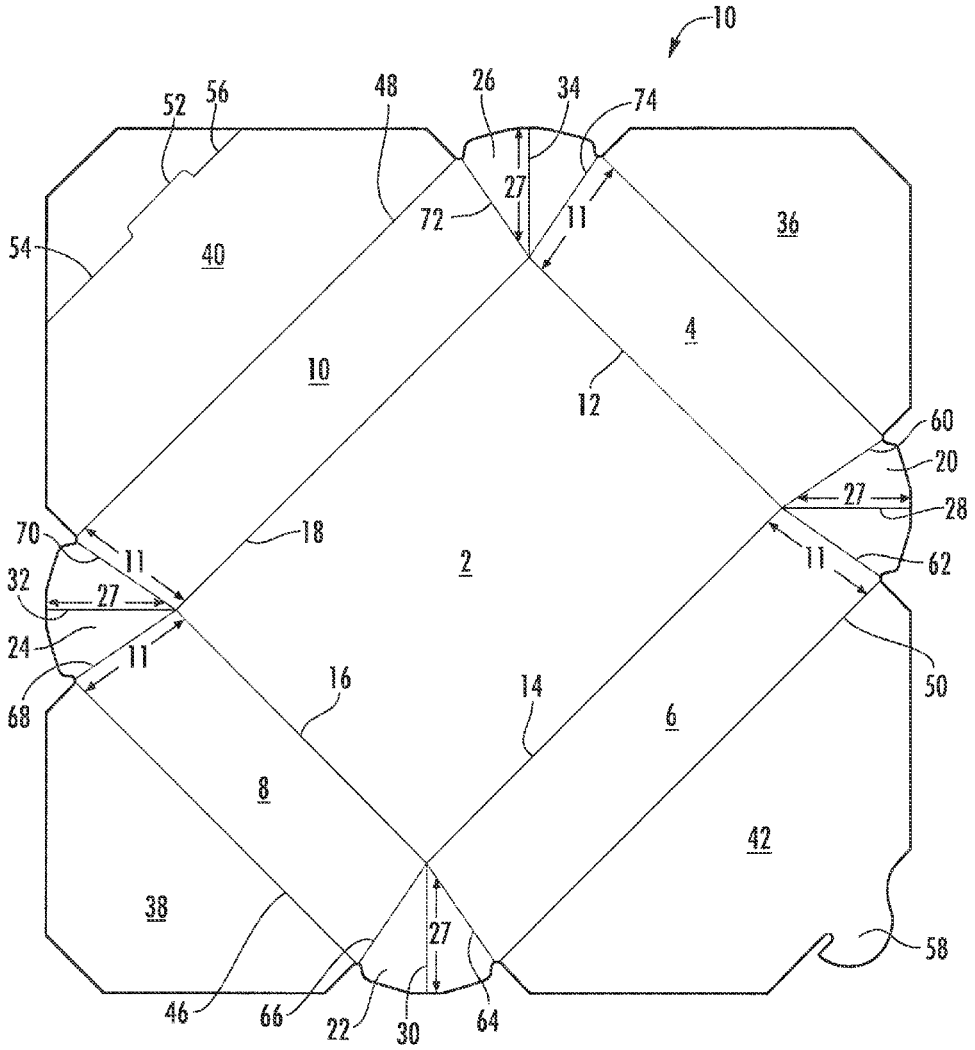
FIG. 1 is a plan view of a unitary blank of foldable material which may be folded and glued into a reclosable food tray according to one embodiment.

Referring now to the drawings for a better understanding of the invention, FIG. 1 illustrates a single blank 1 of foldable material. The foldable material may be paper-based material such as paperboard or corrugated sheet material, although other materials may be used if desired. In embodiments utilizing paperboard, the paperboard may be virgin or recycled material, may be coated or uncoated, and may be single-ply or laminated paperboard. The foldable material may be from about 0.012 inch to about 0.024 inch thick, although it may have any suitable thickness. In some embodiments, the foldable material may be solid bleached sulfate (SBS) with ½ mil low density polyethylene (LDPE), while in other embodiments the foldable material may be SBS with ¾ mil LDPE, while in still yet other embodiments, any other suitable foldable material may be used. Unless otherwise stated, within the borders of an illustration of a blank, solid lines indicate fold lines, score lines, perforation lines, or other lines of weakness.

As illustrated, blank 1 includes a bottom panel 2 that is generally rectangular in shape, though it may be any other suitable shape and have any desired dimensions. Side panels 4, 6, 8, 10 are foldably connected to the respective edges of bottom panel 2 at fold lines 12, 14, 16, 18, respectively. Side panels 4, 6 are hingedly connected to one another via foldable raised gusset 20. Similarly, side panels 6, 8 are hingedly connected to one another via foldable raised gusset 22, while side panels 8, 10 are hingedly connected to one another via foldable raised gusset 24, and side panels 10, 4 are hingedly connected to one another via foldable raised gusset 26.

Each raised gusset 20, 22, 24, 26 comprises a diagonal fold line 28, 30, 32, 34, respectively. The height 27 of each of the raised gussets 20, 22, 24, 26 is taller than the height 11 of adjacent side panels 4, 6, 8, 10 such that the raised gussets 20, 22, 24, 26 extend beyond the side panels 4, 6, 8, 10 by any suitable height. In some non-limiting embodiments, the gussets 20, 22, 24, 26 extend beyond the side panels 4, 6, 8, 10 by about ⅛ inch to about ⅜ inch, as will be described further below and with reference to FIG. 4.

As shown in FIG. 1, blank 1 also includes a first pair of opposing closure panels 36, 38 and second pair of opposing closure panels 40, 42. Closure panel 36 is contiguous and foldably connected to side panel 4 via fold line 44 and closure panel 38 is contiguous and foldably connected to side panel 8 via fold line 46. Similarly, closure panel 40 is continuous and foldably connected to side panel 10 via fold line 48 and closure panel 42 is contiguous and foldably connected to side panel 6 via fold line 50. In other embodiments, such as the embodiment shown in FIGS. 2 and 5, fold lines 44, 46, 48, 50 may be score lines, perforation lines or other suitable lines of weakness.

Closure panel 40 includes cut slot 52 with fold lines 54, 56 extending generally horizontally from each respective end of slot 52 to the respective edges of closure panel 40. Closure panel 42 includes a hook tab (or hook lock) 58 which is dimensioned to be received with slot 52. In other embodiments, hook tab 58 may be any other suitable types of closure mechanism, such as a tuck tab (or push lock) 112, 114 shown in FIG. 2.

Figure 4:
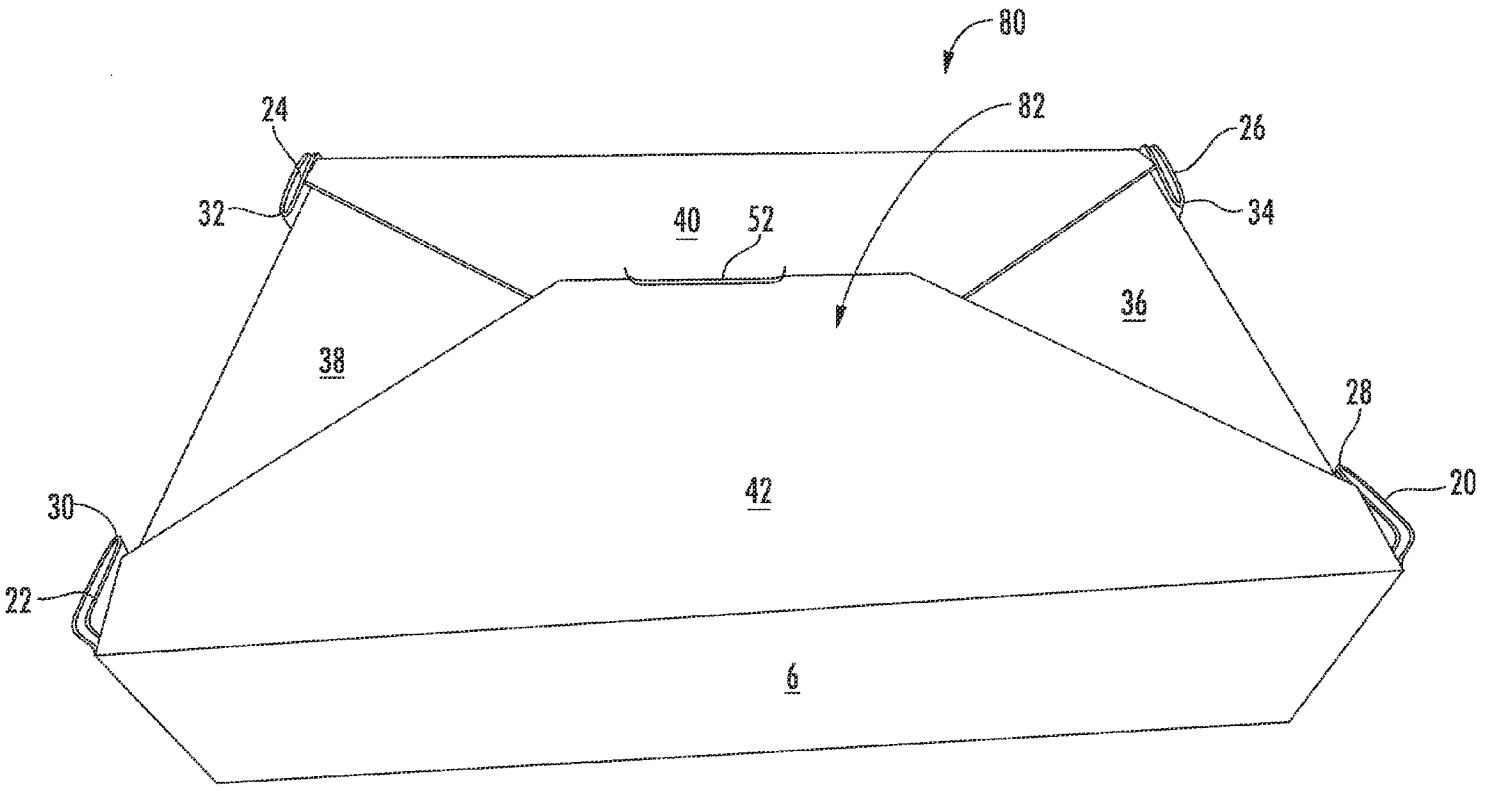
FIG. 4 is a perspective view of an assembled reclosable and stackable food tray formed from the blank of FIG. 1.

The blank 1 shown in FIG. 1 may be erected into the reclosable and stackable food tray as shown in FIG. 4 and described in more detail below. When opposing side panels 4, 8 and 6, 10 are folded substantially upright and substantially perpendicular to bottom panel 2, a tray receptacle is formed. With the side panels 4, 6 folded substantially upright in this manner, raised gusset 20 is folded along fold lines 60, 62, 28 such that raised gusset 20 is folded against the exterior side of side panel 4, as shown. Raised gusset 20 is glued in this position by applying glue between the exterior side of panel 4 and the exterior of gusset 20 where gusset 20 is folded back against panel 4. Similarly, raised gusset 22 is folded and glued in place against side panel 8 via fold lines 64, 66, 30; raised gusset 24 is folded and glued in place against side panel 8 via fold lines 68, 70, 32; and finally raised gusset 26 is folded and glued in place against side panel 4 via fold lines 72, 74, 34. The gluing of raised gussets 20, 22, 24, 26 against opposing side panels 4, 6 may be completed by standard folding and gluing machines. With the side panels 4, 6, 8, 10 folded and glued in place, the closure panels 36, 42, 38, 40 extend generally upright from side panels 4, 6, 8, 10, respectively. This allows the trays to be nested and stacked together with the end user removing a single tray from the nested stack and placing food in the receiving area created between bottom panel 2 and side panels 4, 6, 8, 10.

After introduction of the food in the receiving area of the tray, the opposing closure panels 36, 38 may be folded downward towards and substantially parallel to bottom panel 2, along fold lines 44, 46, to substantially cover the opening of the tray created between side panels 4, 6, 8, and 10. Closure panels 40, 42 may then be folded downward towards bottom panel 2, along fold lines 50, 48 and the now closed closure panels 36, 38 such that the closure panels 40, 42 are substantially parallel to bottom panel 2 and closure panels 36, 38. Closure panels 40, 42 may be secured in place by inserting tab 58 on closure panel 42 through the slot 52 on closure panel 40. The position of closure panels 36, 38 and closure panels 40, 42 and the secure closure created by tab 58 and slot 52 effectively cover the opening of tray and retain the food in the tray, as shown in FIG. 4. The interlocking nature of tab 58 and slot 52 allow for repeatedly opening and reclosing of the tray. It should be understood that any suitable closure mechanism may be used to secure the tray in a closed position.

As shown in FIG. 4, the raised gussets 20, 22, 24, 26 extend above the side panels 4, 6, 8, 10 and the top 82 of the tray 80. In some embodiments, the gussets 20, 22, 24, 26 may extend from about ⅛ inch to about ⅜ inch above the side panels 4, 6, 8, 10 and the top 82 of the tray 80, although other suitable heights may be used in other embodiments. As one of many non-limiting examples, raised gussets 20, 22, 24, 26 assist in properly aligning closure panels 40, 42 as they are folded downwards towards already folded down closure panels 36, 38 by forcing the closure panels 40, 42 to lie between raised gussets 20, 22, 24, 26. By forcing the alignment of closure panels 40, 42 as they are folded down towards the food receiving area and bottom panel 2, it is easier to align hook tab 58 into slot 52 while closing the tray. Once hook tab 58 is inserted in slot 52, the tray 80 is secured in the closed position. With the tray in its closed position, raised gussets 20, 22, 24, 26, which extend above the side panels 4, 6, 8, and 10 and extend above the top 82 of the tray 80, maintain the position of closure panels 40, 42 in their folded down and locked position between side panels 4, 8, which thereby helps prevent skewing of the tray 80. In other words, the raised gussets 20, 22, 24, 26 help maintain the shape of the container by keeping folded down closure panels 40, 42 centered between the elevated gussets 20, 22, 24, 26, as shown in FIG. 4. Without raised gussets 20, 22, 24, 26 extending above the top of side panels 4, 6, 8, 10, closure panels 36, 38, 40, 42 and side panels 4, 6, 8, 10 may be more likely to skew, distorting the intended shape of the tray and potentially weakening the tray. Dimensional skewing of the tray 80 affects the tray's ability to remain properly closed and weakens the tray 80's structural integrity. By preventing skewing, the tray 80 better retains its generally rectangular shape and maintains the closed position of the tray 80, better retains the food within the tray, and maintains its structural integrity and strength.

In addition, in circumstances in which side panels 4, 8 experience forces pushing inwards, the raised gussets 20, 22, 24, 26 act as a stop against closure panels 40, 42 and prevent the side panels 4, 8 from sliding inwards under the closure panels 40, 42. By preventing this shifting or bowing of the side panels 4, 8 inwards, the gussets 24, 26, 28, 30 again aid in maintaining both the dimensional stability of the tray as well as preventing gapping that may result in leakage of the food contents.

In some cases, such as take out or delivery of food, raised gussets 20, 22, 24, 26 also facilitate the stacking of trays on top of one another for transport. When a second tray is stacked on top 82 of the first tray, the raised gussets 20, 22, 24, 26 of the first tray create a raised edge which helps retain the second tray in place on the top of the first tray and prevents the second tray from sliding off the top 82 of the first tray.

While providing the benefits described above, embodiments of the tray, such as that shown in FIG. 4, are capable of being both cut (the blank, as shown in FIG. 1) and erected (as shown in FIG. 4) on standard folding, gluing machines. This would not be the case with trays that include additional pieces that are glued to the side panels and gussets in an effort to create a tray with similar dimensional stability. In contrast, the gluing of the additional pieces requires formers that may be different to the standard former gluers that may be used to erect various embodiments described herein.

Figure 2:
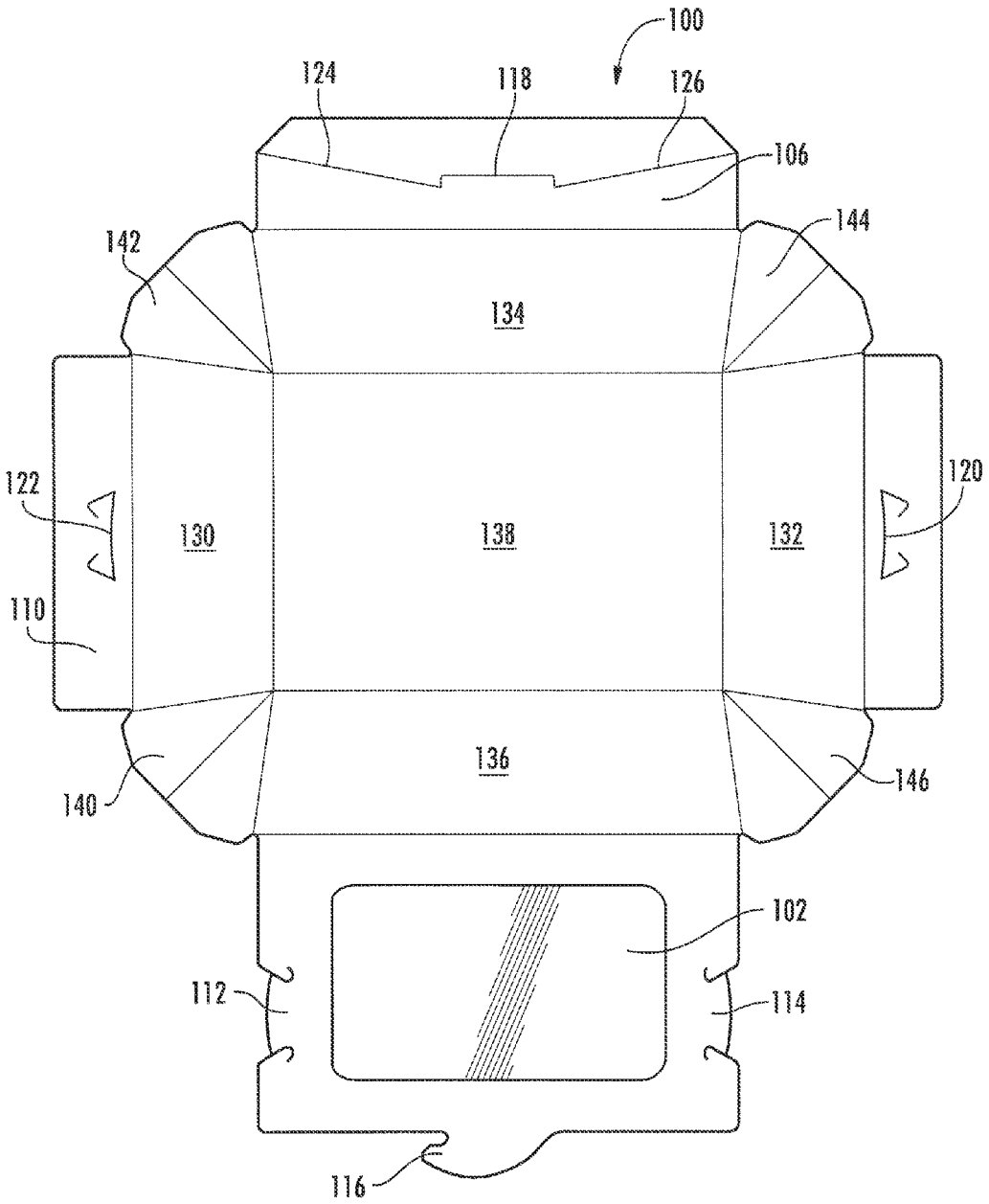
FIG. 2 is a plan view of a unitary blank of foldable material which may be folded and glued into a reclosable food and stackable food tray according to another embodiment.
Figure 5:
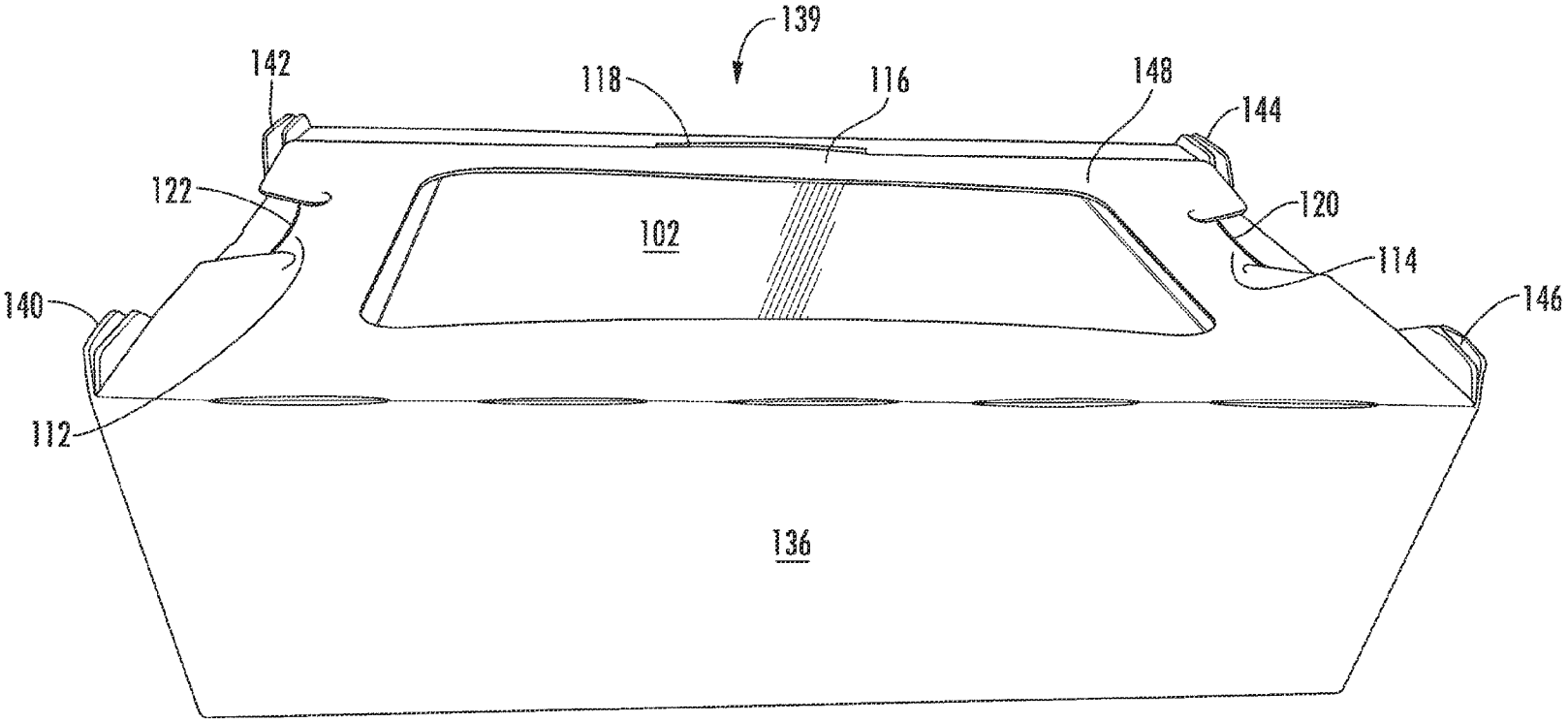
FIG. 5 is a perspective view of an assembled reclosable and stackable food tray formed from the blank of FIG. 2.

FIG. 2 illustrates another embodiment of a single blank 100 that may be folded and glued into the reclosable and stackable food tray as shown in FIG. 5 and described in more detail below. As illustrated in FIG. 2, blank 100 is generally the same in its construction and assembly as the blank 1 shown in FIG. 1 with the changes and additional features described below. The blank 100 shown in FIG. 2 includes a generally rectangular window 102 created by an opening in the closure panel 103 covered by a see-through material such as 1 mil. acetate film, 1 mil. polyester film, or 1 mil. anti fog polypropylene film, though other suitable material may be used. In addition, embodiments may configured so they are microwavable, oven safe and/or refrigerator safe. Depending upon the microwaveable, oven safe or refrigerator safe capability desired, different materials may be chosen for the window. In addition, the glue placement on the blank during erecting is also dependent upon the capability desired. In other embodiments, the window 102 may be of a different size, shape, orientation or may be located in a different position.

The embodiment of the blank 100 shown in FIG. 2 also includes additional tabs as compared to the embodiment shown in FIG. 1, although as mentioned, any suitable closure feature and modifications thereto may be used. In the embodiment shown in FIG. 2, closure panel 104 contains three tabs, 112, 114, 116, one on each exposed edge of the closure panel 104. In this particular embodiment, tabs 112, 114 are tuck tabs while tab 116 is a hook tab. Various combinations of tuck tabs and hook tabs may be used in other embodiments of the invention, and other embodiments may use other suitable types of tabs. Closure panels 106, 108, 110 each have a cut slot, 122, 120, 118, which each corresponds to the size and shape of tabs 112, 114, 116, respectively, and are configured to receive and retain tabs 112, 114, and 116. As shown in FIG. 2, cut slot 118 also includes optional fold lines 124 and 126 which extend from the edges of slot 118 to the outer edges of closure panel 106.

When blank 100 is folded and glued into a tray, as described generally above with respect to FIG. 1, closure panels 104, 106, 108, 110 are folded downwards towards bottom panel 138 until they are generally parallel with bottom panel 138. Unlike the panels shown in the embodiment shown in FIG. 1, closure panels 108, 110 only cover a small portion of the tray's opening while closure panel 104 is comparatively larger and covers substantially all of the opening, or in other words has substantially similar dimensions to the bottom panel 138. Once erected, the window 102 is located on the top 148 of the tray 139 (shown in FIG. 5) so that the contents of the tray 139 may be viewed from above.

The tray 139 may be securely closed by securing tab 116 into slot 118, securing tab 111 into slot 122, and securing tab 114 into slot 120 (see FIG. 5). Securing the closure panels 104, 106, 108, 110 creates what will be referenced as the top 148 (shown in FIG. 5) of the closed tray 139 (shown in FIG. 5). The use of tabs 112, 114, 116 and slots 122, 120, 118 to close the tray 139 also helps the top 148 of tray 139 remain flat and avoid the curling of the recycled paperboard that naturally occurs when folding and securing paperboard. In addition, as shown in FIG. 5, by positioning the tabs 112, 114, 116 and slots 122, 120, 118 close to the sides 130, 132, 134 of the tray 139, the top 148 of the tray lays generally flat and substantially parallel to the bottom panel 138 of tray 139 correcting the edges of the paperboard's tendency to curl towards itself. The interlocking nature of tabs 112, 114, 116 and slots 122, 120, 118 allow for repeated opening and closing of the tray. Moreover, the placement of the tabs 112, 114, 116 as shown in FIG. 2 and FIG. 5 allows for the viewing window to be centered in the closure panel 104. A person having skill in the art would understand that more or fewer tabs may be used in alternative embodiments and the tabs and slots may be shaped or positioned differently than the embodiments shown in the various FIGS.

Figure 3:
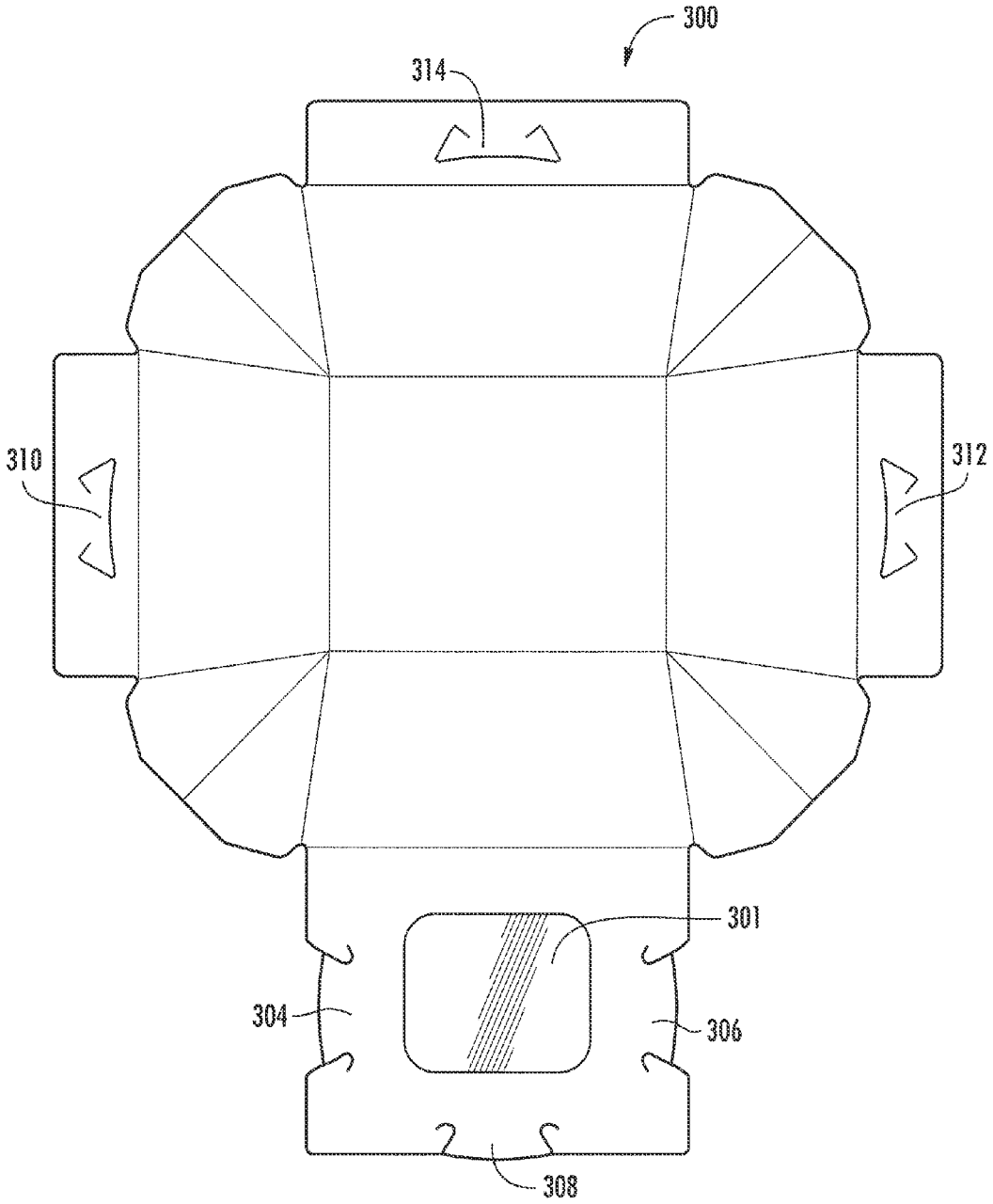
FIG. 3 is a plan view of a unitary blank of foldable material which may be folded and glued into a reclosable food and stackable food tray according to another embodiment.

FIG. 3 illustrates another embodiment of the invention where the blank 300 is a different size and shape than the embodiments shown in FIG. 1 and FIG. 2. Specifically, the embodiment shown in FIG. 3 results in a generally square tray. In addition, the embodiment shown in FIG. 3 has a window 302 that is generally a square shape. In addition the tabs 304, 306, 308 utilized in the embodiment shown in FIG. 3 are tuck tabs that each fit into respective slots 310, 312, 314.

FIG. 5 is a perspective view of an assembled reclosable and stackable formed from the blank of FIG. 2. As shown in FIG. 5, raised gussets 140, 142, 144, 146 extend above the side panels 130, 132, 134, 136 and the top 148 of the tray 139. As described above with reference to FIG. 1 and FIG. 4, the extended height of the gussets 140, 142, 144, 146 helps prevent side panels 130, 132 from being forced inwards and aid in maintaining the structural integrity of the tray 139 by preventing skewing of the trays sides. In addition, the raised gussets 140, 142, 144, 146 help to keep stacked trays from sliding off one another when stacked.

Figure 6:
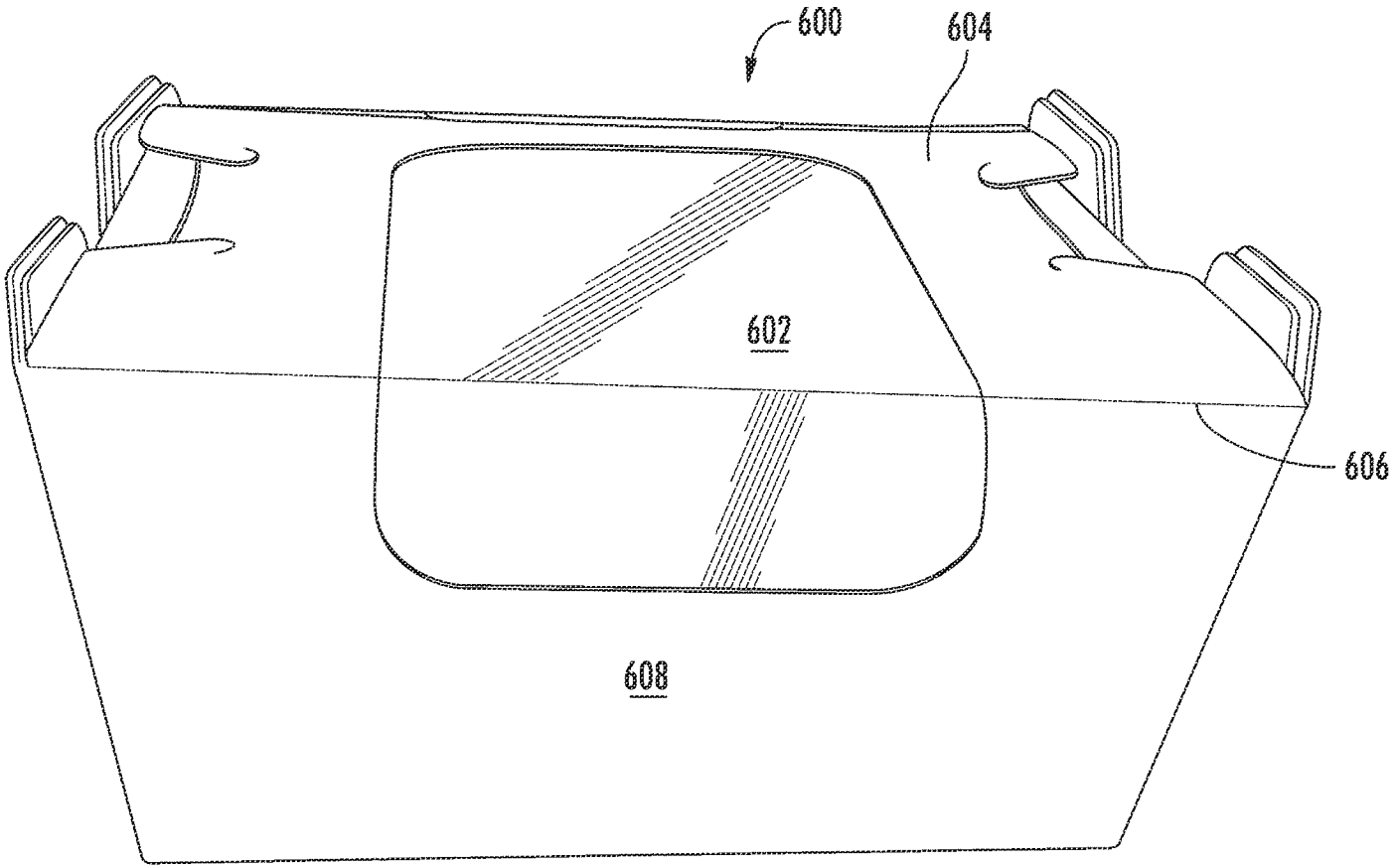
FIG. 6 is a perspective view of an embodiment of an assembled reclosable and stackable food tray according to another embodiment.

FIG. 6 is a perspective view of an embodiment of an assembled reclosable and stackable food tray 600. The embodiment of FIG. 6 has a window 602 that extends from the top panel 604 of the tray 600 over fold line 606 and into side panel 608 of the tray. In this embodiment, even after stacking multiple trays on top of one another, it is possible to view the contents within each of the trays given the placement of the window alongside 608.

Figure 7:
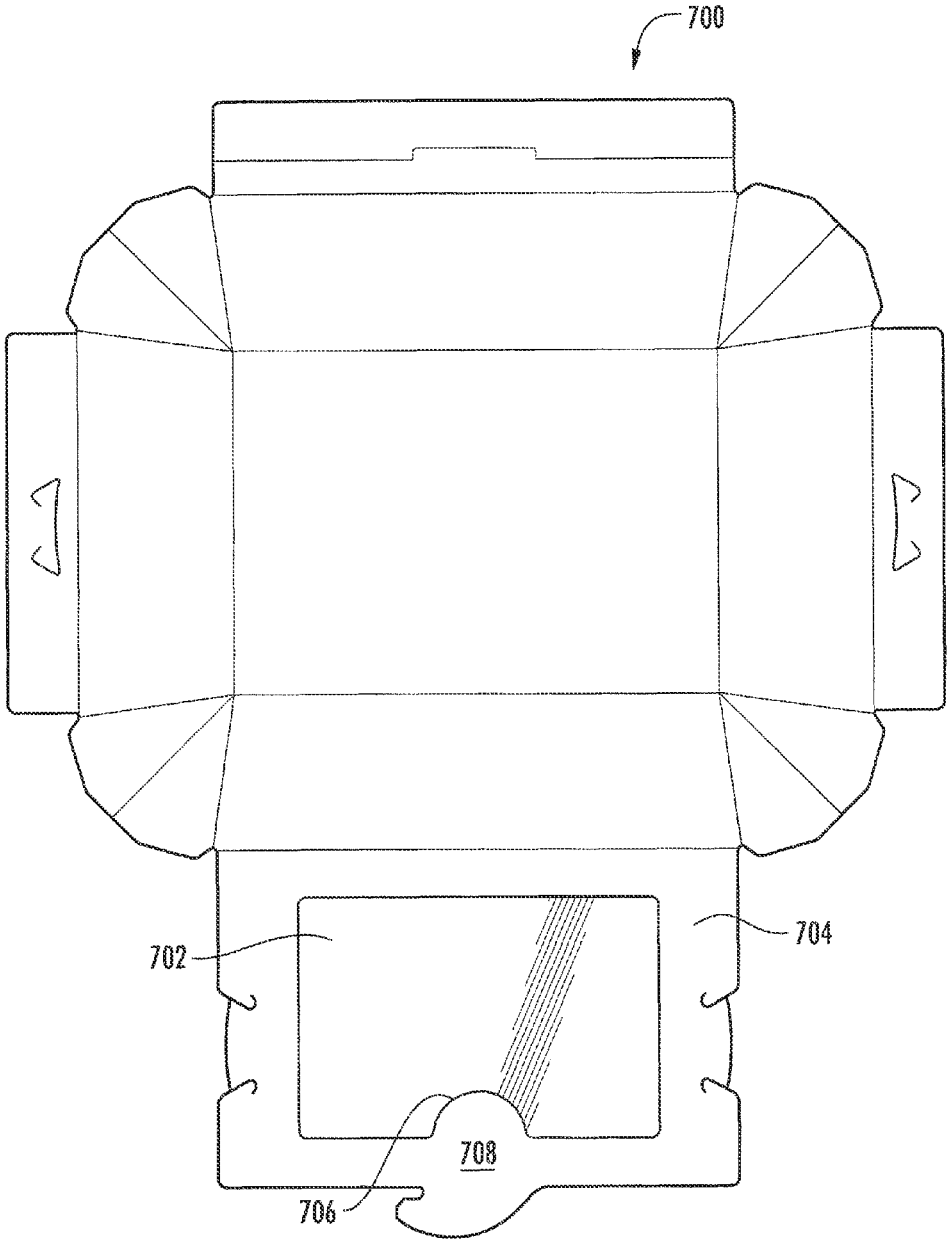
FIG. 7 is a perspective view of a unitary blank of foldable material which may be folded and glued into a reclosable food and stackable food tray according to another embodiment.

FIG. 7 is a perspective view of a unitary blank 700 of foldable material which may be folded and glued into a reclosable food and stackable food tray according to another embodiment. The embodiment of the blank 700 shown in FIG. 7 includes an alternative window shape that maximizes the size of the window 702 on the closure flap 704, while still retaining enough paperboard on the closure flap 704 to provide a strong and study tray. In addition, the embodiment shown in FIG. 7 includes a small semi-circle 706 within the window 702 that allows for expanded print space 708 on the closure flap 704 for inclusion of a graphic such as a logo, company name.

Figure 8:
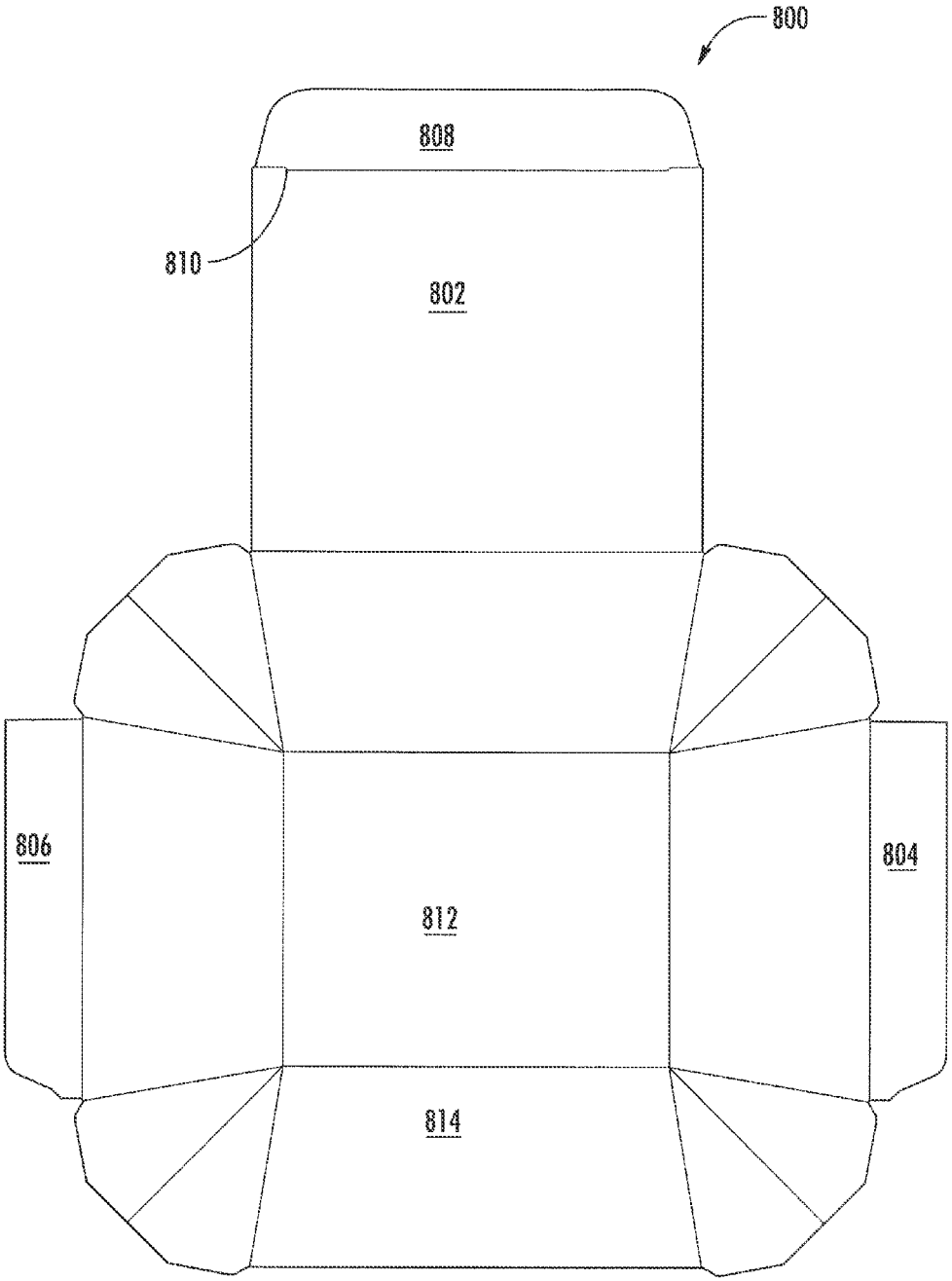
FIG. 8 is a perspective view of a unitary blank of foldable material which may be folded and glued into a reclosable and stackable food tray according to another embodiment.

FIG. 8 is a perspective view of a unitary blank 800 of foldable material which may be folded and glued into a reclosable food and stackable food tray according to another embodiment. The embodiment of the blank 800 shown in FIG. 8 includes an alternative closure method to the tabs and corresponding slots described in the embodiments shown in FIGS. 1-3 and FIG. 7. The blank 800 includes closure panels 802, 804 and 806. Closure panel 802 is substantially larger than closer panels 804, 806 and also includes a closure tab 808 which is contiguous and foldably connected to closure panel 802 at fold line 810. When blank 800 is erected into a reclosable and stackable food tray, the tray may be closed by folding closure panels 804, 806 downwards towards the bottom panel 812 of the tray, folding closure panel 802 downwards towards the bottom panel 812 on top of closure panels 804, 806 and folding tab 808 downwards so it is substantially perpendicular to bottom panel 812 and abutting the interior side of side panel 814. The tray formed from blank 800 is maintained in its closed position by the tight fit of closure panel 802 within the tray opening and the pressure of tab 808 against the interior of side panel 814.

The embodiments of the releasable and stackable food tray blanks described herein are capable of being formed, folded, and glued on standard equipment, thus reducing capital investment and labor costs. As mentioned, the blanks used to erect formed trays in accordance with this invention are not limited to the dimensions and configurations illustrated in the Figures.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A reclosable and stackable food tray formed from a single piece of foldable material, the reclosable and stackable food tray comprising:

a bottom panel;

first and second side panels that are adjacent one another;

third and fourth side panels that are adjacent one another; and a top panel;

wherein the first and second side panels are foldably connected to one another by a first gusset and the second and third side panels are foldably connected to one another by a second gusset, wherein the first and second gussets each have a height that is greater than a height of the first and second side panels such that the first and second gussets extend beyond the top panel of the tray;

wherein the third and fourth side panels are foldably connected to one another by a third gusset and the fourth and first side panels are foldably connected to one another by a fourth gusset, wherein each of the third and fourth gussets has a height that is greater than a height of the third and fourth side panels such that the third and fourth gussets extends beyond the top panel of the tray;

wherein the first and second gussets are folded and glued against an exterior side of the second side panel and the third and fourth gussets are folded and glued against an exterior side of the fourth side panel; and wherein the first, second, third, and fourth gussets are configured to act as stops to prevent the top panel from skewing beyond each gusset.

2. The reclosable and stackable food tray of claim 1, wherein the top panel comprises a first top flap, a second top flap, a third top flap and a fourth top flap, wherein the first top flap extends from the first side panel, the second top flap extends from the second side panel, the third top flap extends from the third side panel, and the fourth top flap extends from the fourth side panel.

3. The reclosable and stackable food tray of claim 2, wherein the first top flap comprises a first tab on a first edge of the first top flap and the third top flap comprises a first slot configured to receive the first tab.

4. The reclosable and stackable food tray of claim 1, wherein the top panel comprises a window.

5. The reclosable and stackable food tray of claim 2, wherein the first top flap is substantially larger than each of the second, third and fourth top flaps.

6. The reclosable and stackable food tray of claim 3, wherein the first tab is a hook tab or a tuck tab.

7. The reclosable and stackable food tray of claim 4, wherein the first top flap is larger than the second, third, and fourth top flaps and has dimensions that are substantially the same as dimensions of the bottom panel.

8. The reclosable and stackable food tray of claim 1, wherein each of the four gussets extends beyond the height of the first, second, third and fourth side panels by about ⅛ inch to about ⅜ inch.

9. A reclosable and stackable food tray formed from a single piece of foldable material, the reclosable and stackable food tray comprising:

a bottom panel;

first and second side panels that are adjacent one another;

third and fourth side panels that are adjacent one another;

a top panel comprising a first top flap, a second top flap, a third top flap and a fourth top flap, wherein the first top flap extends from the first side panel, the second top flap extends from the second side panel, the third top flap extends from the third side panel, and the fourth top flap extends from the fourth side panel;

wherein the first top flap comprises a first tab on a first edge of the first top flap and the third top flap comprises a first slot configured to receive the first tab and wherein the first top flap further comprises a second tab on a second edge of the first top flap, and wherein one of the first top flap and the third top flap comprises a second slot configured to receive the second tab;

wherein the first and second side panels are foldably connected to one another by a first gusset and the second and third side panels are foldably connected to one another by a second gusset, wherein the first and second gussets each have a height that is greater than a height of the first and second side panels such that the first and second gussets extend beyond the top panel of the tray;

wherein the third and fourth side panels are foldably connected to one another by a third gusset and the fourth and first side panels are foldably connected to one another by a fourth gusset, wherein each of the third and fourth gussets has a height that is greater than a height of the third and fourth side panels such that the third and fourth gussets extends beyond the top panel of the tray; and wherein the first, second, third, and fourth gussets are configured to act as stops to prevent the top panel from skewing beyond each gusset.

* * * * *